United States Patent [19]

Schultz

[11] 4,146,259

[45] Mar. 27, 1979

[54] BAG HOLDER AND SCOOP

[76] Inventor: Francis R. Schultz, 280 El Paso, Carol Stream, Ill. 60187

[21] Appl. No.: 849,073

[22] Filed: Nov. 7, 1977

[51] Int. Cl.[2] ..... A01K 29/00

[52] U.S. Cl. ..... 294/19 R; 294/1 R; 294/55

[58] Field of Search ..... 294/1 R, 19 R, 55; 15/257.1; 141/108; 150/7; 229/62; 248/95, 99, 100

[56] References Cited

U.S. PATENT DOCUMENTS

| | | | |
|---|---|---|---|
| 1,266,522 | 5/1918 | Oldham | 141/108 |
| 3,281,178 | 10/1966 | Fisher | 294/1 R |
| 3,720,367 | 3/1973 | Rayner et al. | 229/62 |
| 3,754,785 | 8/1973 | Anderson | 294/19 R |
| 3,757,737 | 9/1973 | Drum et al. | 294/55 X |
| 3,810,670 | 5/1974 | Turi | 294/19 R |
| 4,019,768 | 4/1977 | Niece | 294/1 R X |

*Primary Examiner*—Johnny D. Cherry
*Attorney, Agent, or Firm*—Robert D. Teichert

[57] ABSTRACT

A bag holder and scoop device for hand operation in picking up animal refuse from the ground and disposing of same, having a yoke and yoke connection which support a bag in an open condition. The bag is of the type that has a pocket and a flap at its open end, with the pocket being secured to the yoke connection by enveloping same and the flap being secured to the yoke by impaling on prongs extending from the sides of the yoke.

3 Claims, 9 Drawing Figures

BAG HOLDER AND SCOOP

BACKGROUND OF THE INVENTION

The nuisance and unsanitary condition of animal refuse on the ground is of private and public concern. The growth of urban areas and the increase in pets has directed attention to the problem to the point where anti-defecation laws are becoming a part of many local ordinances and codes.

However, whether by compulsion or voluntarily, the need for a satisfactory hand tool to pick up animal refuse from the ground for disposal is very evident. Many such devices are available in the marketplace but most of them are shovels or dust pan type scoops which require transfer of the animal refuse to a separate disposable sack or bag, or if designed to scoop and store in a single operation are complex in construction and/or cumbersome in operation.

There is a need for a lightweight hand tool which is easy to operate and to which a disposable bag can be readily attached and removed in a simple fashion. Such a tool should not require maintenance of working parts nor a continual cleaning of the tool. Such a tool should be operable with a degree of decorum.

SUMMARY OF THE INVENTION

The purpose of my bag holder and scoop device is to provide a tool that can be held in one hand and operated in a standing position to scoop up animal refuse from the ground and in the scooping deposit such refuse in a disposable bag.

It is also a purpose of my invention to provide in such a device a simple and fast method for attaching a disposable bag to said device and removing said bag for disposal.

It is further a purpose of my device to secure the bag in such a manner that the device is shielded from contact with the animal refuse.

Such construction as I now describe and claim is designed to be used with disposable bags now readily available on the market and operable with simplicity and ease.

DESCRIPTION OF THE DRAWINGS

As shown in FIG. 1 the bag holder and scoop indicated by reference numeral 10 is comprised essentially to a handle 12 having a free end 14 and at the other end 16 a yoke 18 and a yoke connector 20. The handle 12 is of sufficient length so that in grasping the free end 14 the yoke 18 can be disposed adjacent ground level without need of the operator to scoop or bend over.

As shown in FIGS. 2, 3 and 4 the yoke 18 is formed integral with the handle 12 in a general semi-circular configuration, indicated by reference numeral 22, to provide spaced apart support members 24 and 26 extending in a plane parallel to said handle, said support members having prongs 28 and 30, respectively, formed on their outer surfaces. As will be described later, the prongs 28 and 30 are positioned at the point of juncture between the semi-circular yoke portion 22 and the support members 24 and 26.

Figure 1:
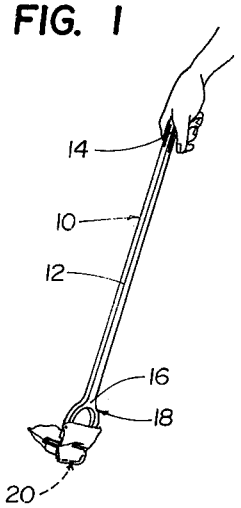
FIG. 1 is a perspective view of the bag holder and scoop shown in operating position.

The yoke connector 20 is a wire member of specific configuration having a central portion 32 spanning substantially the distance between the support members 24 and 26, and being connected thereto by leg members 34, 34. Each of the leg members 34, 34 is comprised of one terminal portion 36 integral with the central portion 32 and another terminal portion 38 attached to an adjacent support member, 24 and 26, of the yoke, with an intermediate portion 40 formed to provide parallel spaced apart members 42 and 44 disposed axially in relation to said yoke 18. For a purpose to be described, member 42 which extends from terminal portion 38 is approximately one-half the length of member 44 which extends from terminal portion 36.

Figure 5:
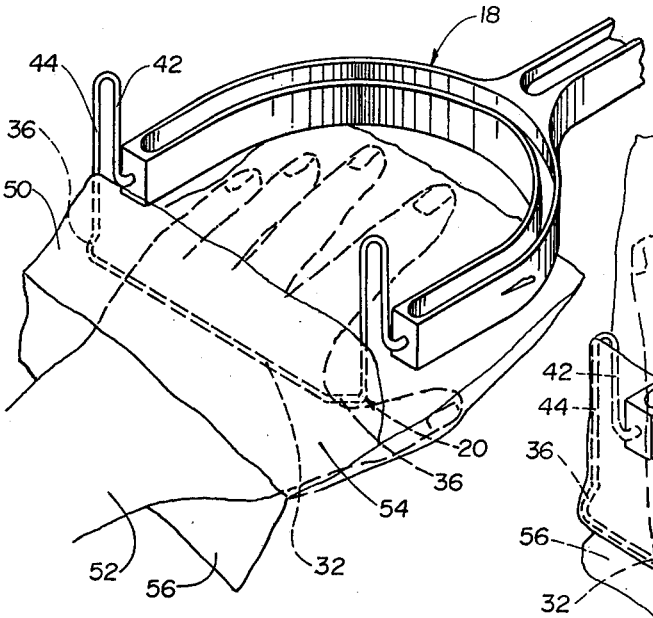
FIG. 5 is an enlarged perspective view of the yoke end of the bag holder and scoop, from the opposite side as that shown in FIG. 2, with an illustration of a hand manipulating a bag into the yoke and yoke connector or attachment thereto.
Figure 6:
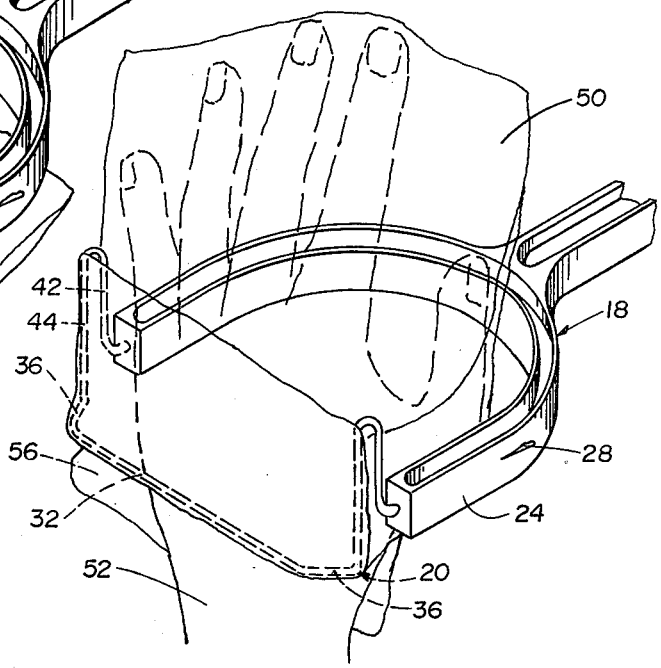
FIG. 6 is a view similar to that of FIG. 5 but showing additional manipulation of the bag with partial attachment of the bag to the yoke connector.

Referring now to FIG. 5, a bag 50 having the hand of an operator, indicated as 52, inserted therein is being manipulated into the yoke 18 for attachment thereto. The bag 50 is preferably of a clear plastic material and is provided with a pocket 54 across one side of the mouth end of the bag. In the position as shown, movement of the hand 52 slightly upward and into the yoke 18 disposes the central portion 32 and terminal portions 36, 36 of the yoke connector 20 within the pocket 54 of bag 50, as shown in FIG. 6. Upon continued upward movement of the bag 50, members 44, 44 are also disposed within the pocket 54 and the central portion 32 and terminal portions 36, 36 are moved fully into said pocket.

Figure 9:
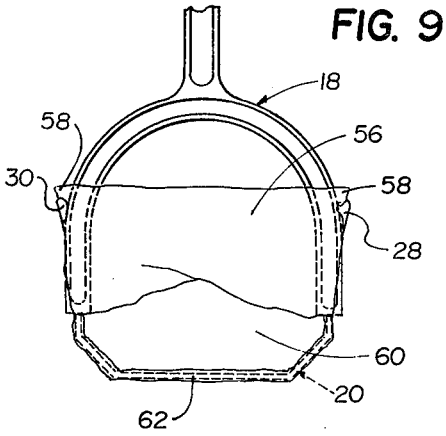
FIG. 9 is a view similar to that of FIG. 3 but showing the bag attached to the yoke and yoke connector.
Figure 2:
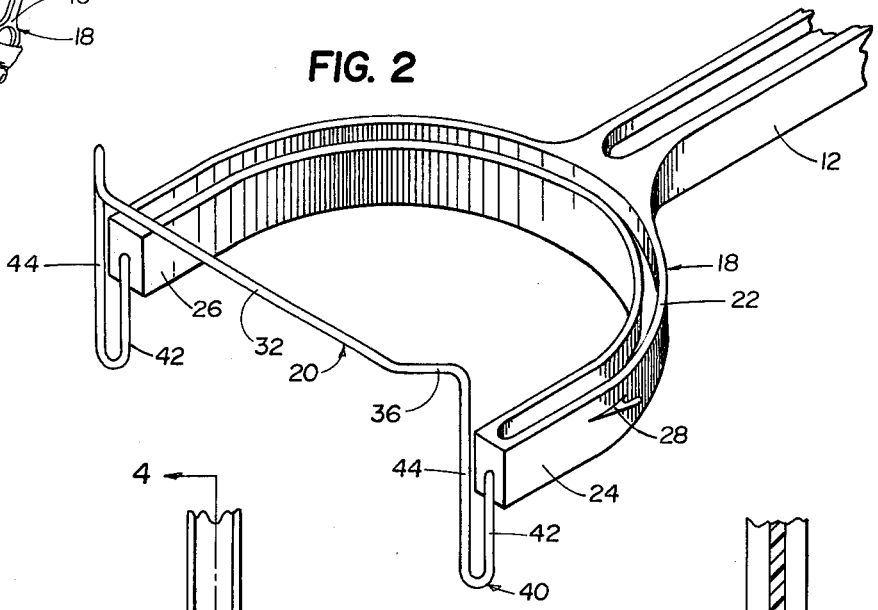
FIG. 2 is an enlarged perspective view of the yoke end of the bag holder and scoop.
Figure 3:
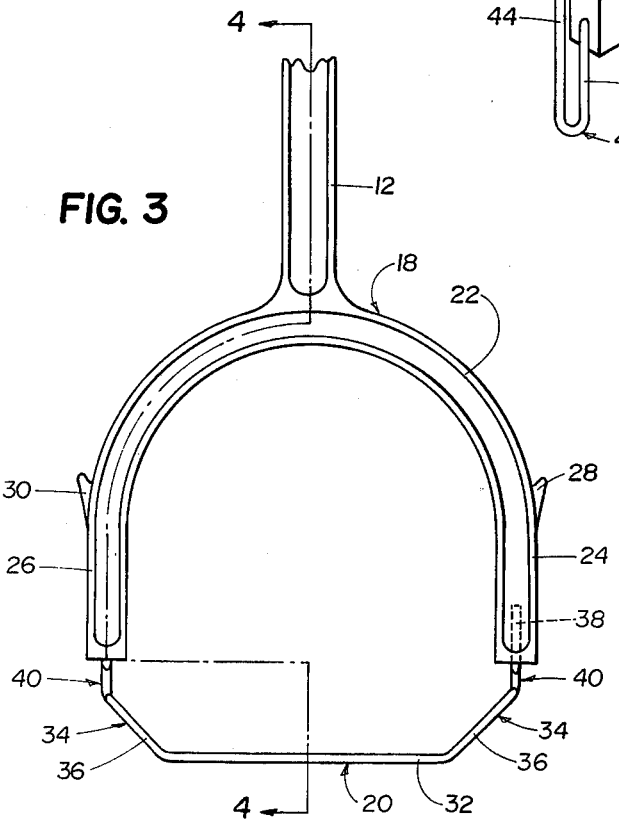
FIG. 3 is an enlarged front plan view of the yoke end of the bag holder and scoop.
Figure 4:
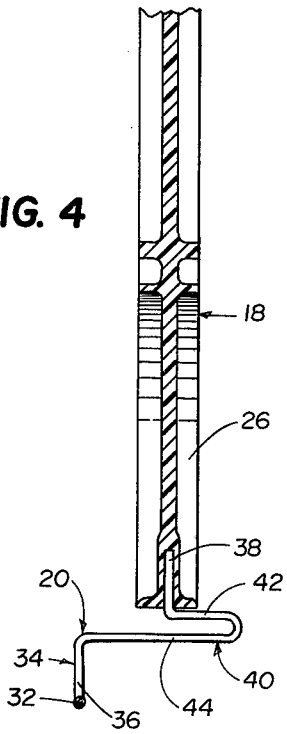
FIG. 4 is a sectional view taken on lines 4—4 of FIG. 3.
Figure 7:
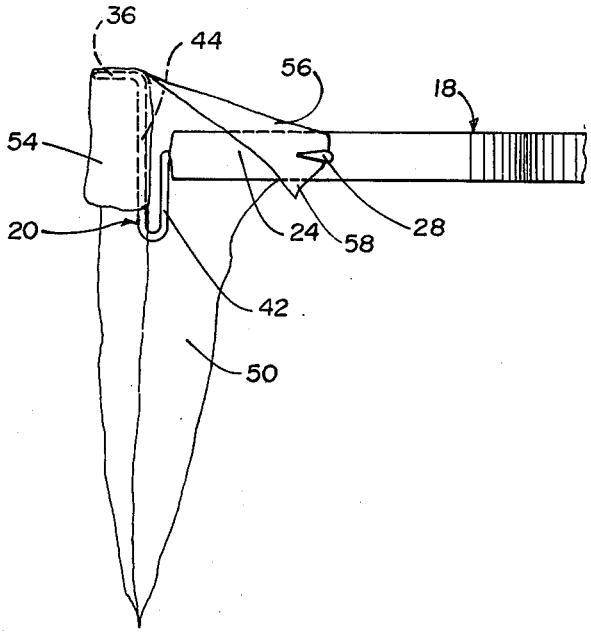
FIG. 7 is an enlarged side elevational view of the bag holder and scoop showing the bag attached to the yoke and yoke connector.

With the bag 50 manipulated through the yoke 18 and the described portions of the yoke connector 20 entrapped within the bag pocket 54, the flap portion 56 of the bag 50 can be manipulated and stretched to impale corner portions 58, 58 on prongs 28 and 30, see FIG. 7 and 9. In such secured condition the bag 50 presents an open mouth, indicated by reference numeral 60, with a defined lip portion 62 which is relatively thin and rigid. As best seen in FIGS. 1 and 9, the lip portion 62 is a leading edge of the open mouth bag which can be operated for movement along the ground passing under debris, such as animal refuse, and directing same into the bag 50.

It should be noted that the yoke 18 and yoke connector 20 are constructed in a specific manner to accomodate the pocket/flap bag illustrated, which bag is of a type readily available in the marketplace. The arrangement of spaced apart members 42 and 44 of the yoke connector 20 is such that the pocket 54 when fully seated on member 44 provides a lip 62 disposed downwardly and offset from the plane of the yoke 18, which in the manner of operation provides a lip for scooping which lies forward of the yoke proper.

The disposition of member 42 spaced apart from member 44 and extending rearwardly from the yoke 18 accommodates the pocket 54 while maintaining the mouth of the bag relatively close to said yoke. Such arrangement provides firm support for the bag while facilitating the scooping operation through easy visibility of the lip of the bag.

As previously pointed out the positionment of the prongs 28 and 30 is such in relation to the yoke connector 20 as to produce a maximum opening of the bag mouth when portions of the flap are impaled on said prongs.

Figure 8:
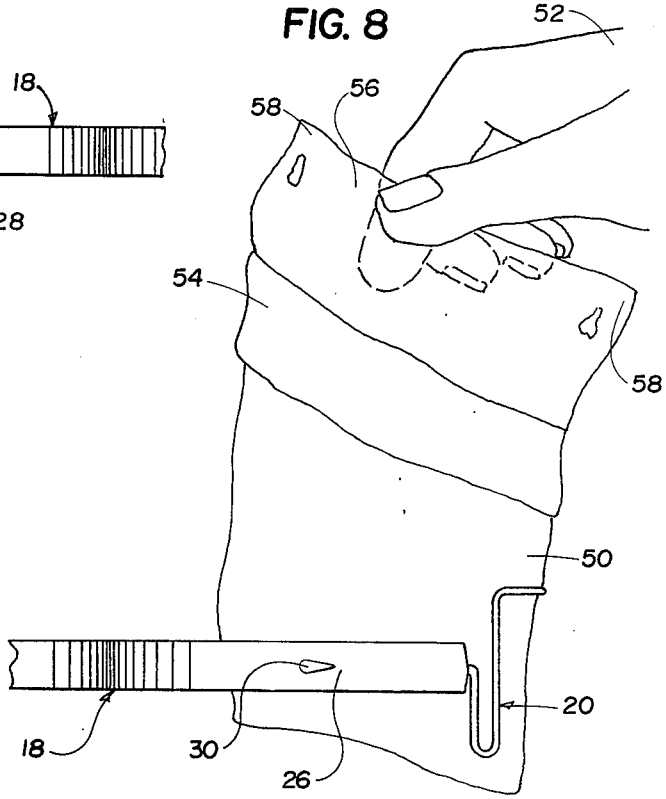
FIG. 8 is an enlarged side elevational view of the bag holder and scoop showing a hand manipulating the bag to remove said bag from attachment with the yoke and yoke connector of the bag holder and scoop.

As shown in FIG. 8 removal of the bag 50 for disposal of the bag and its contents is accomplished by holding the scoop 10 in a horizontal position with the bag mouth open upwardly, and by grasping the flap 56 with the fingers of the operators hand 52 an upwardly pull disengages the flap from prongs 28 and 30. Continued upward movement lifts the bag completely out from the yoke.

It should be noted that the construction of my bag holder and scoop device is such that it accomodates a disposable bag available in the marketplace; the bag is easily secured to and removed from the device; the device is shielded by the bag from direct contact with animal refuse; and a portion of the bag is always maintained "clean" for grasping by the operator for removal and disposal.

While I have described a preferred embodiment of my bag holder and scoop, it should be understood that various modifications could be applied without departing from the scope of my invention.

I claim:

1. A bag holder and scoop comprising an elongated handle, a yoke formed integral at one end of said handle providing spaced apart support members, said support members each having a prong formed thereon, a connector having a central portion spanning substantially the distance between said support members and terminating in leg members secured to the support members, said leg members having a configuration to dispose the central portion of said connector in a plane parallel to the plane of the support members of the yoke, each of the leg members of the connector formed to provide parallel spaced apart portions of unequal length disposed in a plane normal to the plane of the support members of the yoke and having the longer of said unequal spaced apart portions connected to the central portion of said connector and the shorter of said unequal spaced apart portions connected to the respective adjacent support member of said yoke, a disposable bag having a pocket and a flap formed at the open end of said bag, said pocket having the central portion of the connector disposed therein and said flap secured to the prongs of the support members whereby the open end of said bag is releasably secured to said connector and said support members.

2. A bag holder and scoop according to claim 1 wherein the connector is a wire member.

3. A bag holder and scoop according to claim 2 wherein the prongs of the support members are located on the surfaces thereof remote from each other and spaced from the central portion of the connector whereby securement of the bag flap thereto holds the bag in a stressed position to provide a bag opening and the pocket and flap shield said support members and said connector from said bag opening.

* * * * *